United States Patent [19]

Quarve

[11] 4,068,982

[45] Jan. 17, 1978

[54] CHARGE CONTROL VALVE AND PISTON ASSEMBLY FOR DIAPHRAGM PUMP

[75] Inventor: Vernon K. Quarve, Minneapolis, Minn.

[73] Assignee: Graco Inc., Minneapolis, Minn.

[21] Appl. No.: 752,419

[22] Filed: Dec. 20, 1976

[51] Int. Cl.[2] ..... F04B 9/10; F04B 35/02

[52] U.S. Cl. ..... 417/387; 60/592

[58] Field of Search ..... 417/383, 385, 387, 388; 60/543, 594, 592

[56] References Cited

U.S. PATENT DOCUMENTS

| | | | |
|---|---|---|---|
| 3,106,164 | 10/1963 | McCormick | 417/383 |
| 3,153,381 | 10/1964 | Holley | 417/388 |
| 3,496,875 | 2/1970 | Van Allen et al. | 417/388 |
| 3,977,192 | 8/1976 | Smirnov et al. | 417/383 |

FOREIGN PATENT DOCUMENTS

| | | | |
|---|---|---|---|
| 1,963,446 | 6/1971 | Germany | 417/383 |

*Primary Examiner*—Carlton R. Croyle
*Assistant Examiner*—Thomas I. Ross
*Attorney, Agent, or Firm*—Paul L. Sjoquist

[57] ABSTRACT

An apparatus for reciprocating a piston in a diaphragm pump wherein the piston alternately pressurizes and relieves an oil filled chamber having a diaphragm separating the chamber from a liquid pumping chamber, the invention comprising a bearing shoe interposed between the piston and driving crank shaft, wherein the shoe has oil ports for lubricating and for relieving excess fluid volume from the oil chamber during each piston stroke.

10 Claims, 8 Drawing Figures

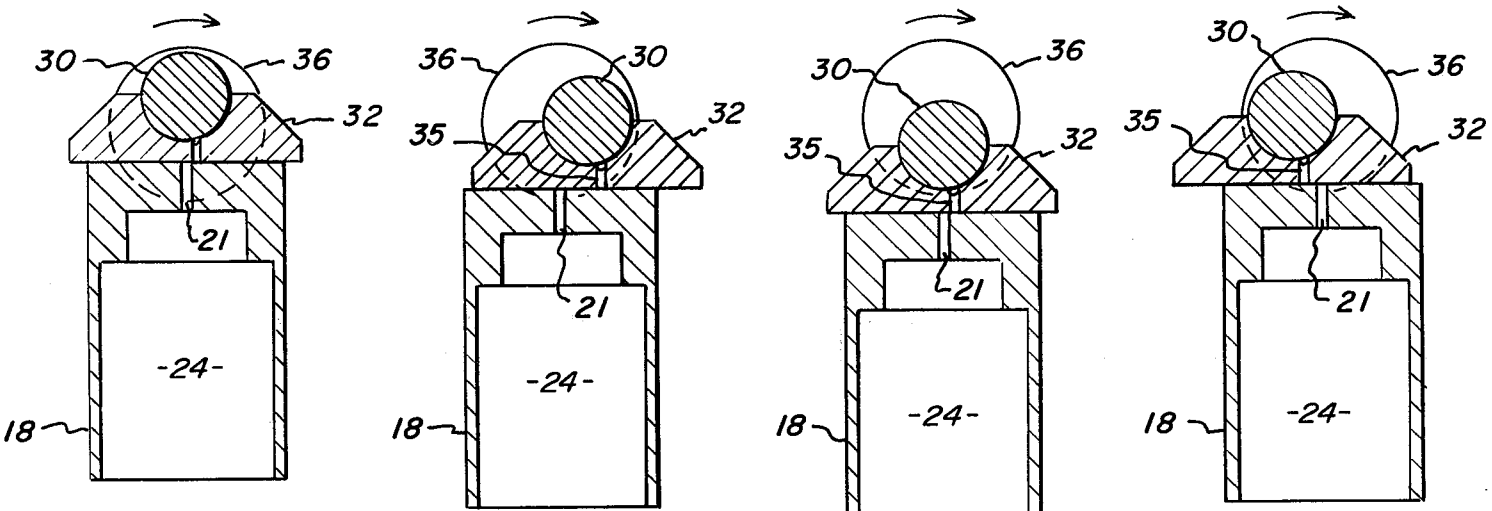
FIG. 5A
FIG. 5B
FIG. 5C
FIG. 5D
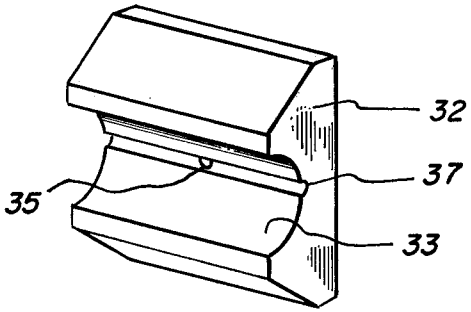
FIG. 3

CHARGE CONTROL VALVE AND PISTON ASSEMBLY FOR DIAPHRAGM PUMP

CROSS-REFERENCES TO RELATED APPLICATIONS

The present invention relates to diaphragm pumps and improvements therefore which are disclosed in several copending applications filed by the assignee of the present invention. Among these related applications is U.S. Ser. No. 701,807, filed July 1, 1976, now U.S. Pat. No. 4,050,859, which discloses an apparatus for improving diaphragm wear characteristics, wherein a piston reciprocating member and driving member similar to the present invention is also disclosed. Another related application is Ser. No. 593,449, filed July 7, 1975, now U.S. Pat. No. 4,019,395, which discloses a diaphragm pump piston reciprocating drive assembly of the type disclosed herein, and wherein the present invention represents an improvement thereon. A third related application is U.S. Ser. No. 582,262, filed May 30, 1975, now U.S. Pat. No. 4,019,837, which discloses a piston drive assembly of the type to which the present invention represents an improvement.

BACKGROUND OF THE INVENTION

The invention relates generally to diaphragm pumping devices, and particularly to improvements to such devices for enhancing pumping capability and for reducing diaphragm wear and breakage problems. Diaphragm pumps represent an extremely efficient approach to pumping liquids through the use of reciprocating flexible membrane which may be used to expand and contract a liquid pumping chamber having suitable input and output control valves. The most significant problem associated with such diaphragm pumps is the problem of protecting the diaphragm membrane from breakage. In the idealized situation the flexible diaphragm, made from rubber or plastic material, is interposed between two fluid-filled chambers. The chamber on one side of the diaphragm is filled with hydraulic oil and the chamber on the other side of the diaphragm is filled with the liquid to be pumped, such as water, paint, or other fairly low viscosity fluid. The oil-filled chamber is alternately pressurized and relieved and the pumping chamber is correspondingly filled and emptied through suitable control valves, to deliver pumped liquid at elevated pressures. The pressure forces across the diaphragm are, to the highest extent possible, kept in equilibrium so that the diaphragm itself experiences very little pressure gradient. This enables a diaphragm, which itself has high resiliency and poor capability of withstanding differential pressures over several pounds per square inch (p.s.i.), to be able to deliver fluid pressures upwards of several thousand p.s.i. Therefore, the design goals which must be achieved in proper diaphragm pump construction require that pressure stresses across the diaphragm be minimized at all times during the reciprocating stroke of the diaphragm.

Yet another problem which must be considered in the proper design of a diaphragm pump is the control of the diaphragm mean deflection position. In an idealized situation the diaphragm deflects forward and backward an amount equal to the stroke of the driving piston, and this deflection is from a "rest" position usually determined by the circumferential line where the diaphragm edge is fastened to the pump structure. To the extent that the hydraulic oil volume in the enclosed chamber, bounded by the driving piston on one end and the diaphragm on the other end, can be kept at a constant "ideal" volume, the diaphragm deflection will always occur between the same forward and backward positions. In an actual situation the fluid volume in the oil filled chamber can accumulate beyond the "ideal" volume and thereby cause the diaphragm to deflect about a mean position which shifts from its intermediate "rest" position. As this mean deflection position shifts it causes increased stress on the diaphragm, because the edge of the diaphragm remains fastened to the pump structure along its circumferential line but the maximum deflection distance moves farther from this line. If uncontrolled, this effect will ultimately cause the diaphragm to rupture.

Attempts at minimizing forces across the diaphragm in the prior art have always manifested themselves in valve controls in each of the two reciprocating stroke directions. Techniques and apparatus have been devised for relieving excess oil pressure during the pressure stroke and in replenishing deficient oil volume during the return stroke, or alternatively unloading and relieving pumped liquid pressure.

Another problem which has been dealt with in the prior art is the apparatus for reciprocating a diaphragm. A large number of piston-operated reciprocating devices have been introduced into the art, which have been driven by crank assemblies, wobble plates, cams, and other reciprocating motion drive sources. The inventors herein have found the conventional crank shaft to give the most preferred driving operation for this type of pump, particularly when used in conjunction with the apparatus disclosed herein.

SUMMARY OF THE INVENTION

The present invention comprises a novel bearing shoe interposed between a rotatable crank or offset cam and a reciprocating piston in a diaphragm pump. The piston has a port passing through it, one side in contact with the oil-filled chamber and the other side contacting the bearing surface of the bearing shoe. The shoe has a port from its piston-contacting surface to its surface contacting the driving crank. An oil groove extends along the crank bearing surface to provide means for lubricating the movable components, as well as to provide a relief passage between oil reservoir and oil-filled chamber during each reciprocating stroke of the piston, when the bearing shoe port and the piston port come into coincidence. It insures that a predetermined oil volume of the oil-filled chamber is relieved once during each piston stroke, thereby providing a nominal operating oil volume reference to control the maximum upper limit on internal oil volume, and thereby control mean diaphragm deflection position for regulating the maximum stress on the diaphragm.

BRIEF DESCRIPTION OF THE DRAWINGS

A preferred embodiment of the invention is disclosed herein, and illustrated in the attached drawings, in which:

FIG. 3 shows the bearing shoe in bottom perspective view;

FIG. 5A shows the invention in the piston return position;

FIG. 5B shows the invention during the piston forward stroke;

FIG. 5C shows the invention in the piston forward position; and

FIG. 5D shows the invention during the piston return stroke.

DESCRIPTION OF THE PREFERRED EMBODIMENT

Figures 1, 2:
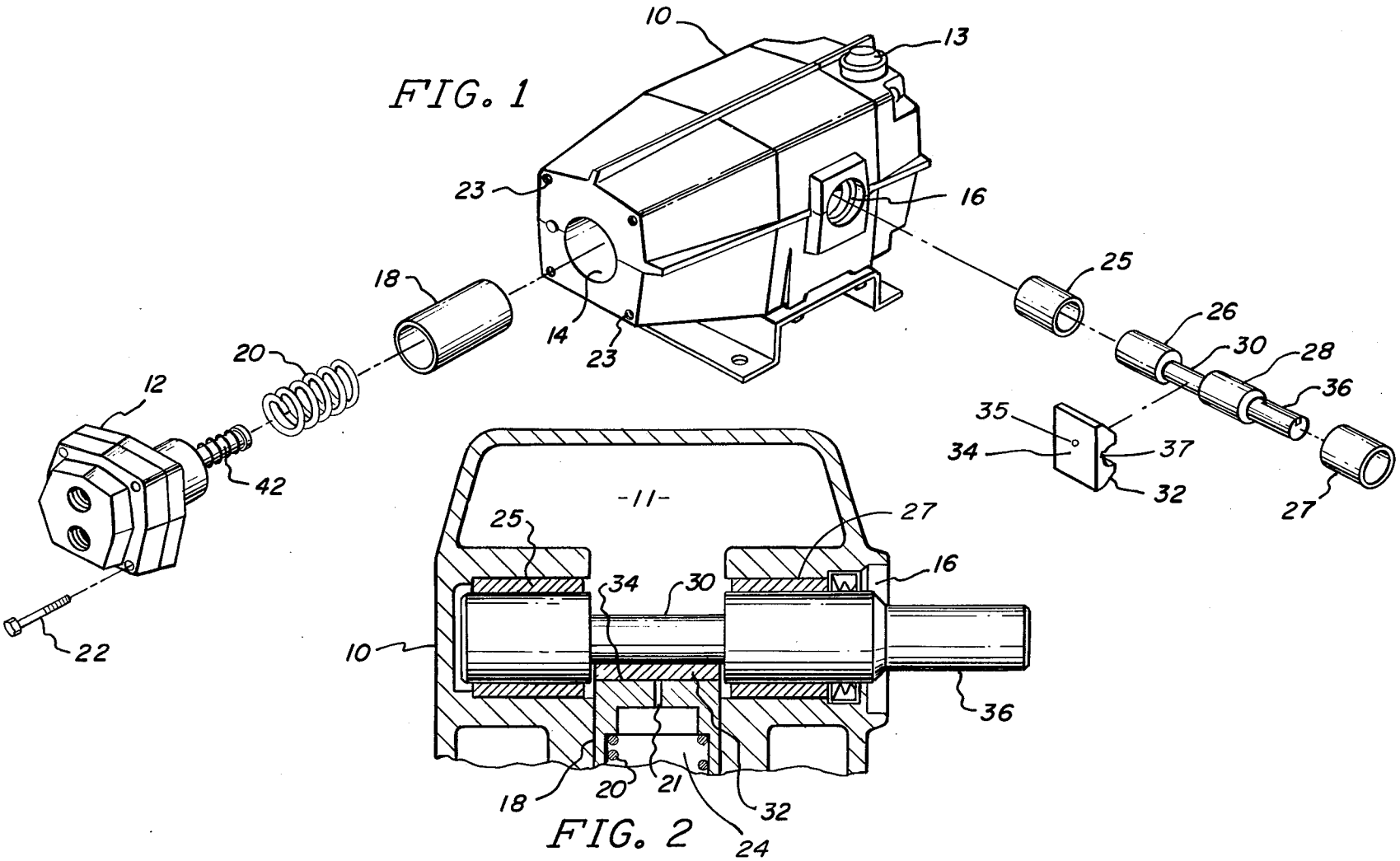
FIG. 1 illustrates a diaphragm pump having the inventive components shown in exploded view.
FIG. 2 is a cross-sectional top view of the invention.

Referring first to FIG. 1, the invention is shown in exploded perspective view, wherein the components are expanded along their axial directions. A diaphragm pump 10 is shown, having a single cylinder 14 and piston 18 for reciprocating therein. Other equally preferable embodiments could comprise multi-cylinder diaphragm pumps, the essential features of operation being the same as disclosed herein. Piston 18 is biased inwardly toward drive shaft 36 by a spring 20 which recesses inside of piston 18 and is restrained by pumping chamber assembly 12. Assembly 12 is bolted to the pump 10 by means of bolts 22 fastened into threaded holes 23.

Drive shaft 36 is inserted into diaphragm pump bore 16 and is rotatably mounted in bushings 25 and 27. Journal surfaces 26 and 28 provide a bearing upon which drive shaft 36 may rotate within the bushings. A bearing shoe 32 has a lower curved surface mated to crank 30, which itself is axially offset from the axis of drive shaft 36. A top surface 34 of bearing shoe 32 bears against the underside of piston 18 for smooth bearing contact therewith. When drive shaft 36 is connected to a suitable rotary power source, such as an electrical motor, a crank 30 causes piston 18 to reciprocate, the rotary motion of crank 30 being translated into reciprocating motion through bearing shoe 32.

FIG. 2 illustrates the invention in a top cross-section taken along the axis of drive shaft 36 and piston 18. Bushings 25 and 27 are inserted through bore 16, and drive shaft 36 is inserted therein. Bearing shoe 32 is interposed between crank 30 and piston 18. A port 21 passes through the end of piston 18 to provide a flow path between bearing surface 34 and the oil pressure chamber 24 adjacent piston 18. Port 21 provides a means for porting between the oil-filled chamber 24 and reservoir 11 as will be hereinafter described. Under normal conditions oil reservoir 11 is at atmospheric pressure, being vented through oil filler cap 13 or otherwise.

FIG. 3 shows in bottom perspective view the bearing shoe 32. A rounded surface 33 is constructed to be in mating curvature with crank 30. An oil groove 37 extends from an edge of bearing shoe 32 to at least a point in communication with a port 35, which port is drilled through bearing shoe 32 to open into top surface 34. In the preferred embodiment, port 35 is directed along a non-radial line from surface 33 for reasons which will be hereinafter described. Bearing shoe 32 is preferably constructed from bronze or other standard material used for such applications. Oil groove 37 may extend entirely across surface 33 and thereby provide a lubrication channel to better lubricate the crank 30 and the undersurface of bearing shoe 32, as well as to provide a relief passage for oil in the chamber 24.

Figure 4:
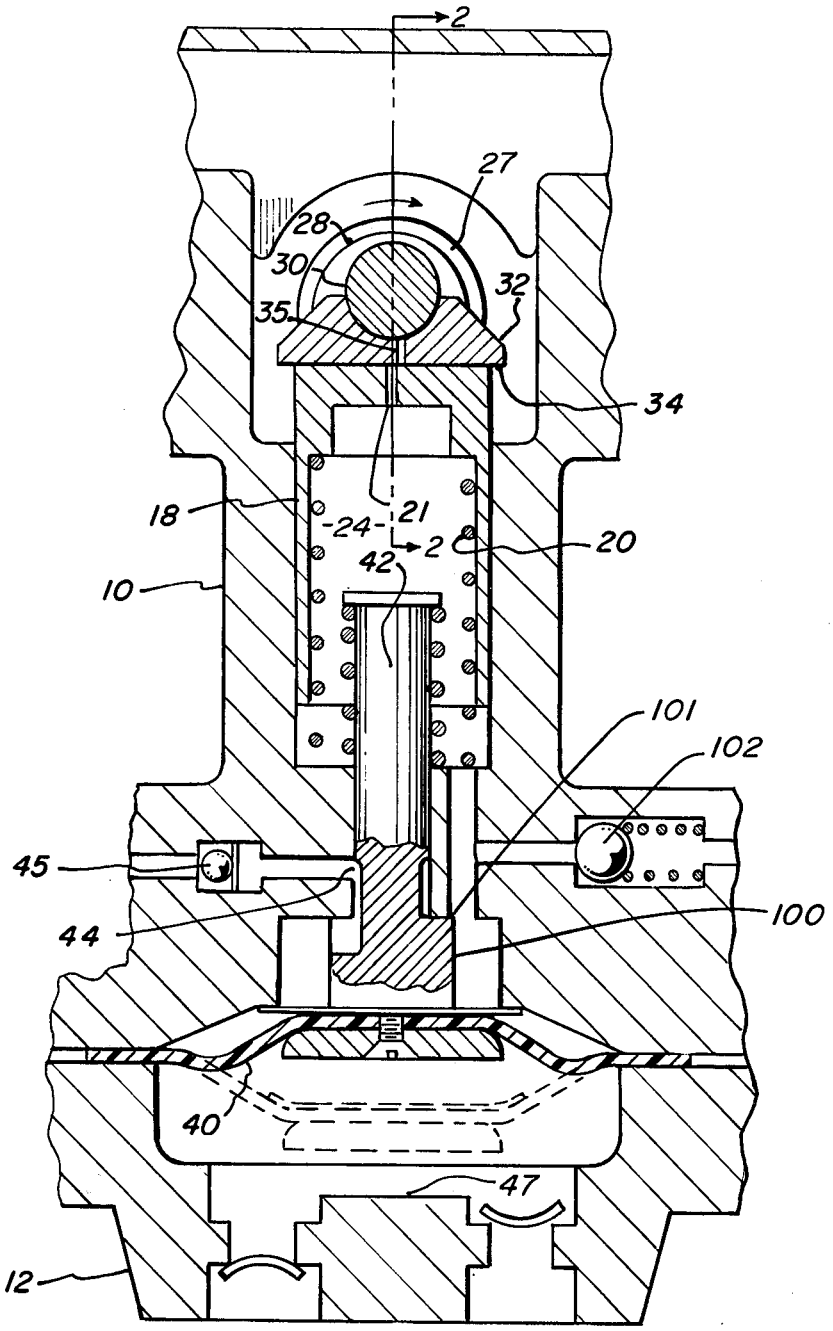
FIG. 4 shows a diaphragm pump in end view cross section.

FIG. 4 shows an end view cross-sectional view of a diaphragm pump taken through the center of the piston 18 and cylinder. Drive shaft 36 is presumed to be rotating in the direction shown by the arrow, and crank 30 is therefore moving in a direction to urge piston 18 into its pressure stroke. Port 35 is displaced laterally from piston port 21, but as drive shaft 36 continues to rotate port 35 moves into alignment with piston port 21 at some point during the piston stroke. In the preferred embodiment, the point of initial alignment of port 21 with port 35 occurs at a drive shaft 36 position which is several degrees past the upper dead center limit of piston 18. In time, this occurs just after piston 18 is beginning its return stroke.

FIG. 4 also shows diaphragm 40 and slide valve 42 in their fully returned position, which occurs when shoulder 100 contacts stop 101 and piston 18 retracts to its bottom position, which occurs when crank 30 is at bottom dead center. When these components are in these positions the volume defined by the space in chamber 24 and bounded by diaphragm 40, valve 102, valve 45 and piston 18 has a value V which will be referred to herein as the "ideal" volume V. Under optimum operating conditions this volume is exactly filled with hydraulic oil, and so the "ideal" oil volume is always V. As the piston 18 reciprocates it moves this oil volume and thereby causes the diaphragm to reciprocate, and to the extent that oil volume V remains enclosed between the piston 18 and diaphragm 40, the diaphragm 40 will deflect in repeatable correspondence with piston 18. However, in actual operation a small amount of oil leaks past piston 18 and through check valves 45 and 102, thus reducing the internal oil volume to $V - v$. An amount of oil volume v must therefore be added to or replenished to the chamber 24 in order to maintain the pumping efficiency of diaphragm 40 in correspondence with the stroke of piston 18.

Replenishment of oil volume $v$ is accomplished by the combination of slide valve 42 and check valve 45. Since slide valve 42 is attached to diaphragm 40 it moves in a 1 : 1 correspondence with the diaphragm between a forward position defined by the dotted outline for diaphragm 40 and a rearward position which occurs when shoulder 100 contacts stop 101. When the oil volume in chamber 24 decreases to a value $V - v$, shoulder 100 will contact stop 101 *before* piston 18 reaches its rearmost position. The continued rearward movement of piston 18 causes a negative pressure to develop in chamber 24, relative to oil reservoir 11, which permits check valve 45 to open and admit oil from reservoir 11 to chamber 24 via the passage 44 which becomes opened by slide valve 42. Under optimum conditions, the amount of oil admitted in this manner to chamber 24 is $v$, which returns the total chamber 24 oil volume to the value V. When piston 18 reverses its stroke direction and begins its pressure stroke a positive pressure is developed in chamber 24 relative to check valve 45, which closes check valve 45 to contain the oil volume in chamber 24. Further movement of piston 18 in its pressure stroke forces diaphragm 40 forward and closes slide valve 42 over passage 44. This last feature assures that a negative pressure in chamber 24 will open check valve 45 *only* when shoulder 100 is positioned against its stop 101, which is when slide valve 42 is in a position to uncover passage 44.

The foregoing description illustrates the operation of slide valve 42 and check valve 45 under optimum operating conditions. However, it has been found under certain dynamic operating circumstances these valve mechanisms tend to admit too much oil into chamber 24, and a gradual build-up of excess oil volume occurs.

This is thought to be caused by a combination of factors, involving the dynamic characteristics of slide valve 42 and check valve 45. The effect of this excess oil volume build-up in chamber 24 is to cause the mean deflection position of diaphragm 40 to move toward surface 47. If unchecked, the gradual shifting of the mean diaphragm deflection position will increase the stress on diaphragm 40 and will ultimately cause a diaphragm rupture. However, the alignment of port 35 with port 21 during each cycle of the piston provides an automatic oil volume relief for the chamber 24 and ensures that excess fluid volume cannot accumulate. The excess oil accumulated in chamber 24 is relieved during the brief period of time when port 21 and 35 are in coincidence, shortly after the end of the piston pressure stroke. The quantity of oil which passes through these ports is determined by the net pressure in chamber 24 and as this pressure tends to increase the quantity of oil relieved also tends to increase. The cross-sectional area of port 21 and port 35 is selected to provide fluid volume relief to chamber 24 of an amount to ensure that diaphragm 40 will return to its stop during the return stroke of piston 18. The fluid volume which passes through these ports is actually more than would be necessary under normal operating conditions, with the result that some oil will be replenished through check valve 45 during every return stroke of piston 18. However, by designing ports 21 and 35 in this manner, the aforementioned shifting of diaphragm deflection mean position is avoided and the diaphragm does not suffer the adverse stresses which could otherwise occur. Since ports 21 and 35 come into alignment only after the piston has passed its forward-most pressure stroke position there is no loss of pumping efficiency. The maximum permissible cross-sectional area of ports 21 and 35 must be less than the effective area of the flow path through replenishing check valve 45, for if the ports were made larger more oil would be relieved through them than could be replenished via check valve 45.

FIG. 5A illustrates piston 18 in its maximum return stroke position, which is the same position as shown in FIG. 4. Drive shaft 36 is rotating in the direction of the arrow, and bearing shoe 32 is moving laterally relative to piston 18. FIG. 5B shows piston 18 midway through its pressure stroke, and bearing shoe 32 is beginning to move laterally in the reverse direction, which moves ports 21 and 35 toward an alignment position. FIG. 5C shows piston 18 at its forward-most pressure stroke position, and port 35 on bearing shoe 32 is just coming into alignment with port 21 on piston 18. As drive shaft 36 continues to rotate port 35 briefly comes into alignment with port 21 and provides a path for relieving excess oil volume from the piston chamber 24. FIG. 5D shows piston 18 midway through its return stroke, and bearing shoe 32 is in a maximum lateral position relative to piston 18 with ports 35 and 21 no longer in coincidence. The net result of this operation is to provide a quick volume relief immediately after the piston has passed its maximum forward position to bleed excess oil from the piston chamber 24. The foregoing operational sequence illustrates the special volume-relieving function of the present invention which has been found to significantly extend the useful life of diaphragms in pumps of this type. Because the oil volume in the piston chamber is relieved *after* the peak pressure position of the piston, the pumping efficiency of the system is not affected.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. In a diaphragm pump of the type having a reciprocating piston for alternately pressurizing and relieving an oil-filled chamber having a diaphragm separating said chamber from a liquid pumping chamber, the improvement in piston reciprocating drive and oil volume control, comprising:

a. a rotatable crankshaft with an axially offset cam;

b. a bearing shoe fitted on said cam and having a bearing surface for contacting said piston, said bearing shoe having an oil groove along its surface fitted on said cam and having an oil port between said groove and said piston bearing surface; and c. a piston oil port passing through said piston and opening to said piston surface contacting said bearing surface, whereby said piston oil port and said bearing shoe oil port come into coincidence during each piston reciprocating stroke.

2. The apparatus of claim 1, wherein said piston oil port is centered on said piston surface.

3. The apparatus of claim 2, wherein said bearing shoe oil port projects through said bearing shoe along a non-radial line relative to said bearing shoe surface fitted on said cam.

4. The apparatus of claim 3, wherein said bearing shoe oil port and said piston oil port come into coincidence at a piston position past its maximum pressure stroke.

5. A diaphragm pump apparatus of the type having a mechanically-reciprocated piston in an oil-filled chamber, one end of which chamber is defined by a flexible diaphragm, comprising:

a. a rotatable crankshaft for providing the reciprocating driving means for said piston;

b. a bearing shoe shaped to fit said crankshaft and having an oil groove along its surface mated to said crankshaft, said bearing shoe having a second surface contacting said piston in reciprocating and sliding relationship;

c. a first port through said piston communicating between said bearing shoe second surface and said oil-filled chamber; and d. a second port through said bearing shoe communicating between said bearing shoe second surface on said oil groove.

6. The apparatus of claim 5, further comprising an oil reservoir in fluid communication with said oil groove and a one-way check valve between said reservoir and said oil-filled chamber, said one-way check valve permitting flow into said chamber at a first volume flow rate upon a pressure differential across said check valve.

7. The apparatus of claim 6 wherein said first port and said second port are in respective alignment so as to come into fluid flow contact after said piston has reciprocated a maximum distance into said oil-filled chamber.

8. The apparatus of claim 7 wherein said first port and said second port are respectively sized to permit a lesser fluid volume flow rate than said one-way check valve.

9. The apparatus of claim 8, wherein said second port passes through said bearing shoe in a non-radial direction relative to said bearing shoe crankshaft-mating surface.

10. The apparatus of claim 9, wherein said bearing shoe oil groove extends along the entire bearing shoe surface contacting said crankshaft.

* * * * *